US009248541B2

(12) United States Patent
Videcoq

(10) Patent No.: US 9,248,541 B2
(45) Date of Patent: Feb. 2, 2016

(54) GRINDING MACHINE FOR OPTICAL GLASS AND ASSOCIATED METHOD OF GRINDING

(75) Inventor: Jean-Jacques Videcoq, Pavilly (FR)

(73) Assignee: LUNEAU TECHNOLOGY OPERATIONS, Pont de l'Arche (FR)

( * ) Notice: Subject to any disclaimer, the term of this patent is extended or adjusted under 35 U.S.C. 154(b) by 727 days.

(21) Appl. No.: 13/415,102

(22) Filed: Mar. 8, 2012

(65) Prior Publication Data

US 2012/0231706 A1 Sep. 13, 2012

(30) Foreign Application Priority Data

Mar. 10, 2011 (FR) ..... 11 51969

(51) Int. Cl.

| | |
|---|---|
| ***B24B 9/14*** | (2006.01) |
| ***B24B 13/00*** | (2006.01) |
| ***B24B 13/005*** | (2006.01) |
| ***B24B 13/06*** | (2006.01) |

(52) U.S. Cl.

CPC . *B24B 9/14* (2013.01); *B24B 13/00* (2013.01); *B24B 13/005* (2013.01); *B24B 13/06* (2013.01)

(58) Field of Classification Search

CPC ..... B24B 9/14; B24B 9/148; B24B 13/00; B24B 13/02; B24B 13/0037; B24B 13/005; B24B 13/06; B24B 9/146

USPC ..... 451/42, 43, 44, 246, 249, 255, 256

See application file for complete search history.

(56) References Cited

U.S. PATENT DOCUMENTS

| | | | | |
|---|---|---|---|---|
| 5,775,973 | A * | 7/1998 | Watanabe | 451/5 |
| RE35,898 | E * | 9/1998 | Shibata et al. | 451/5 |
| 6,702,653 | B2 * | 3/2004 | Shibata | 451/42 |
| 6,984,161 | B2 * | 1/2006 | Suzuki et al. | 451/5 |
| 7,510,459 | B2 * | 3/2009 | Yamamoto | 451/6 |
| 7,617,579 | B2 * | 11/2009 | Natsume | 29/26 A |
| 7,731,565 | B2 * | 6/2010 | Shibata et al. | 451/5 |
| 7,975,355 | B2 * | 7/2011 | Nauche et al. | 29/26 A |
| 8,038,507 | B2 * | 10/2011 | Obayashi | 451/5 |
| 8,128,463 | B2 * | 3/2012 | Lemaire et al. | 451/43 |
| 8,241,091 | B2 * | 8/2012 | Takeichi | 451/5 |
| 8,260,450 | B2 * | 9/2012 | Takeichi | 700/164 |
| 8,342,909 | B2 * | 1/2013 | Lemaire et al. | 451/11 |
| 8,464,409 | B2 * | 6/2013 | Nauche | 29/26 A |
| 8,602,839 | B2 * | 12/2013 | Tanaka et al. | 451/5 |

(Continued)

FOREIGN PATENT DOCUMENTS

WO 2004/087374 A1 10/2004

OTHER PUBLICATIONS

French Search Report, dated Oct. 31, 2011, from corresponding French application.

*Primary Examiner* — Eileen Morgan

(74) *Attorney, Agent, or Firm* — Young & Thompson

(57) ABSTRACT

This machine includes a base frame (17) and a lens support (19) mounted on the frame (17) with the lens support (19) having elements (29A, 29B) for driving a lens (15) into rotation around a first axis. It includes a tool holder set (21) including a rotary shaft (39) around a second axis (C-C') and elements (43) for inclining the first axis (A-A') with respect to the second axis (C-C'). The rotary shaft (39) bears at least two tools (49, 51) for machining the lens, spaced out along the second axis (C-C'), and a spacer (50) positioned in an intermediate area (55) located between both machining tools (49, 51). The spacer (50) defines an outer surface (57) for machining the lens.

11 Claims, 4 Drawing Sheets

(56) References Cited

U.S. PATENT DOCUMENTS

| | | | | |
|---|---|---|---|---|
| 8,747,187 | B2 * | 6/2014 | Lemaire et al. | 451/5 |
| 2001/0053659 | A1 * | 12/2001 | Shibata | 451/42 |
| 2004/0058624 | A1 * | 3/2004 | Suzuki et al. | 451/42 |
| 2006/0217036 | A1 * | 9/2006 | Meunier et al. | 451/5 |
| 2007/0015440 | A1 * | 1/2007 | Natsume | 451/5 |
| 2007/0202775 | A1 * | 8/2007 | Shibata | 451/5 |
| 2007/0259604 | A1 * | 11/2007 | Yamamoto | 451/5 |
| 2009/0068932 | A1 * | 3/2009 | Lemaire et al. | 451/43 |
| 2010/0009603 | A1 * | 1/2010 | Nauche | 451/43 |
| 2010/0093265 | A1 * | 4/2010 | Lemaire et al. | 451/294 |
| 2011/0256804 | A1 * | 10/2011 | Lemaire et al. | 451/5 |

* cited by examiner

GRINDING MACHINE FOR OPTICAL GLASS AND ASSOCIATED METHOD OF GRINDING

FIELD OF THE INVENTION

The present invention relates to a grinding machine for optical glass of the type comprising:

- a base frame;
- a lens support mounted on the frame with the lens support comprising means for driving a lens in rotation around a first axis;
- a tool holder set comprising a rotary shaft around a second axis and means for inclining the first axis with respect to the second axis;
- the rotary shaft bearing at least two tools for machining the lens, spaced out along the second axis, and a spacer positioned in an intermediate area located between the two machining tools.

Such a machine is notably intended to the grinding of ophthalmic lens blanks in order to give them a shape or characteristics adapted to the frame intended to receive the lens.

BACKGROUND OF INVENTION

A grinding machine of the aforementioned type is known from WO 2004/087374, which comprises a main set of grinding wheels intended to grind the periphery of the lens and a tool holder set for scoring, counter-beveling and drilling the lens.

The lens blank is rotatably mounted onto a lens support around a first axis.

The tool holder set comprises a rotary tool holder shaft, which may be inclined with respect to the axis of rotation of the lens on its support.

The rotary shaft in this example bears a scoring wheel intended to form a peripheral groove in the lens, a counter-beveling wheel intended to machine the sharp edges of the lens, and a drilling tool mounted on the free end of the rotary shaft for drilling holes through the lens.

Once the periphery of the lens has been machined, a groove may be formed in the lens by means of the scoring wheel. Alternatively, the sharp edges of the lens, taken along its outline, may be counter-beveled. A hole may be drilled in the lens by inclining the axis of rotation of the shaft with respect to the axis of rotation of the lens and by introducing the drilling tool through the lens.

Such a tool operates in a satisfactory manner. However, it is always useful to further improve the functionalities of the tool while preserving at the same time reduced dimensions.

SUMMARY OF THE INVENTION

Therefore, one object of the invention is to make available a grinding machine, which has increased functionalities while preserving its compact size.

To this end, the object of the invention is a grinding machine of the aforementioned type, characterized in that the spacer defines an outer surface for machining the lens.

The grinding machine according to the invention may comprise one or several of the following characteristics, taken separately or in any technically possible combination:

- the spacer extends as a single piece between a first axial end applied on one of the two tools and a second axial end applied on the other of the two tools;
- the spacer has a substantially cylindrical form;

- the outer surface for machining the lens extends substantially over the entire length of the spacer;
- a first machining tool is a scoring wheel; a second machining tool being a counter-beveling wheel, the spacer being located between the scoring wheel and the counter-beveling wheel;
- a first machining tool is a drilling tool positioned at the free end of the rotary shaft, a second machining tool being a scoring wheel or a counter-beveling wheel; the spacer being located between the drilling tool and the wheel which is closest to the drilling tool;
- the spacer forms a cutting tool for machining the lens;
- the intermediate area has a maximum radial extent of less than 0.8 times the maximum radial extent of at least one of the two machining tools delimiting the intermediate area;
- the length of the spacer, taken along the second axis, is between 10 mm and 20 mm;
- the tool holder set includes a fastening member capable of immobilizing the spacer on the rotary shaft in rotation around the second axis;
- it comprises a set of wheels rotatably mounted on the frame around an axis of the wheels, the axis of the wheels being substantially parallel to the first axis.

An object of the invention is also a method for grinding optical glass, characterized in that it comprises the following steps:

- providing a machine;
- placing a lens blank in the lens support;
- measuring the thickness of the lens blank;
- treating the lens blank with the help of at least one of the machining tools borne by the rotary shaft;
- before and/or after the treatment step, machining the lens blank by contact with the outer machining surface located on the spacer.

BRIEF DESCRIPTION OF THE DRAWINGS

The invention will be better understood upon reading the description that follows, provided only as an example, and made with reference to the appended drawings, wherein.

DETAILED DESCRIPTION OF THE INVENTION

Figure 1:
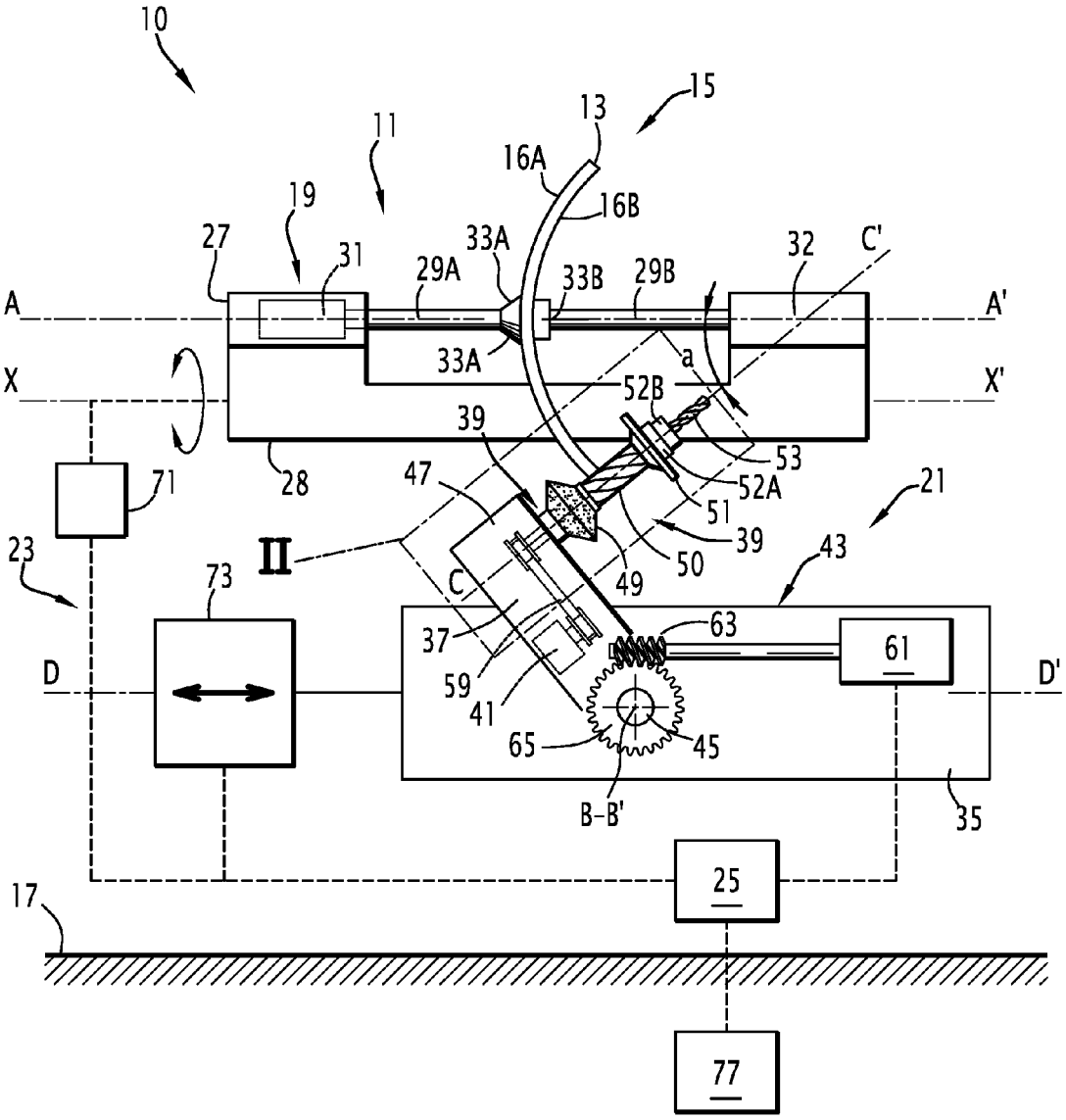
FIG. 1 is a schematic view of a first grinding machine according to the invention.
Figure 2:
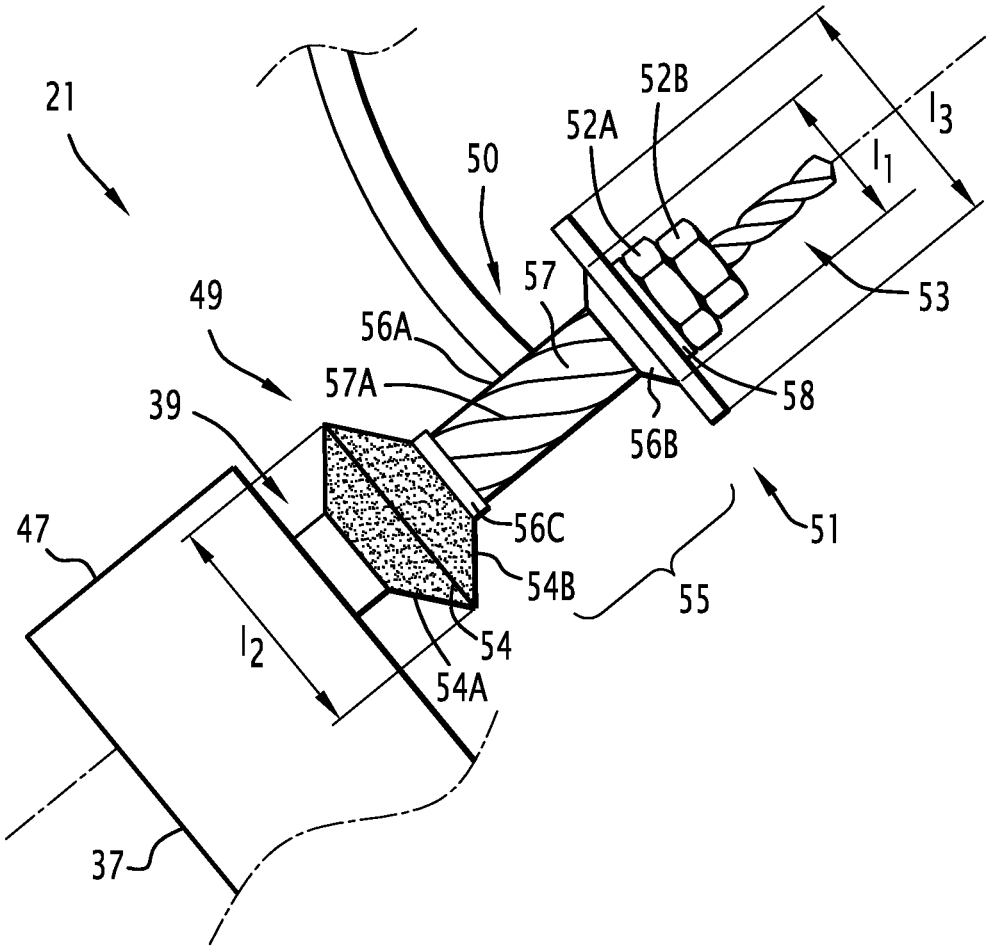
FIG. 2 is an enlarged lateral view of the tool holder set of the machine of FIG. 1.

The first grinding machine 11 according to the invention, illustrated in FIGS. 1 and 2, is intended to finish the peripheral surface 13 of a lens 15 of ophthalmic glass by means of polishing, scoring and counter-beveling operations, the lens 15 having been previously profiled by peripheral grinding.

This machine 11 is also capable of making drill holes through the lens 15, between its front face 16A and its rear face 16B.

As shown in FIG. 1, the machine 11 comprises a base frame 17, a lens support 19, a tool holder set 21, the support 19 and the set 21 being mounted mobile on the base frame 17. The machine 11 further includes means 23 for relative axial and radial positioning of the set 21 with respect to the support 19, means (not shown) for measuring the thickness of the lens and a control unit 25.

The lens support 19 comprises a trolley 27 tiltably mounted onto the base frame 17, the trolley 27 being provided with means for driving the lens 15 into rotation around a first axis A-A'. The driving means include two half-shafts 29A, 29B adapted for grasping the lens 15 and a motor 31 for driving the lens 15 into rotation.

In this example, the trolley 27 is articulated with respect to the base frame 17 by means of a longitudinal rear rim 28, around a substantially horizontal tilting axis X-X'.

Both half-shafts 29A, 29B are mounted along the longitudinal front rim 32 of the trolley 27. These half-shafts 29A, 29B are extending along a first substantially horizontal axis A-A' parallel to the X-X' axis.

The half-shafts 29A, 29B are provided with free ends 33A, 33B, respectively, positioned facing each other and adapted for grasping the lens 15.

The motor 31 for driving the lens 15 drives the half-shafts 29A, 29B into slow rotation around the first axis A-A' by means of a transmission mechanism (not shown).

As illustrated in FIG. 1, the tool holder set 21 comprises a support 35, a connecting arm 37 protruding with respect to the support 35, a rotary tool holder shaft 39, a motor 41 for driving the tool holder shaft 39 into rapid rotation, and means 43 for inclination of the tool holder shaft 39 with respect to the support 35.

The connecting arm 37 is articulated by a first end 45 on the support 35, around a horizontal pivot axis B-B' substantially orthogonal to the first axis A-A'.

The tool holder shaft 39 is rotatably mounted at the free end 47 of the connecting arm around a second axis C-C' substantially orthogonal to the connecting arm 37.

The tool holder shaft 39 bears, between its end connected to the connecting arm 37 and its free end, a first tool for machining the lens 15 formed by a counter-beveling wheel 49, a spacer 50, and a second tool for machining the lens 15 formed by a scoring wheel 51.

The shaft 39 also bears members 52A, 52B for holding the machining tools and a third tool for machining the lens formed by a drilling tool 53 positioned at the free end of the shaft 39.

The tools 49, 51, 53 and the spacer 50 are rotatably mounted interdependently of the tool holder shaft 39. They have as common axis the C-C' axis.

As illustrated by FIG. 2, the counter-beveling wheel 49 has on the outside a median cylindrical surface 54 flanked by two tapered surfaces 54A, 54B which converge by moving away from the median surface 54.

The rear tapered surface 54A has an apex angle that is greater than the one of the front tapered surface 54B, for example, by at least 10°.

Thus, the rear surface 54A has an apex half-angle that is relatively large, for example of the order of 55° and the front surface 54B has an apex half-angle that is relatively smaller, for example of the order of 35°.

The tapered surfaces 54A, 54B are able to remove material in the lens 15 during the rotation of the shaft 39.

The scoring wheel 51 is formed by a disk which comprises a single median cylindrical surface of a limited width. In the example illustrated in FIG. 2, the width of the median cylindrical surface is less than 2 mm and is notably comprised between 0.5 mm and 1.6 mm.

The median cylindrical surface is delimited by two planar transverse surfaces, which are substantially parallel to each other.

The scoring wheel 51 is spaced longitudinally along the C-C' axis of the counter-beveling wheel 49. The tools 49, 51 define between them an intermediate area 55 of the rotary shaft 39 on which the spacer 50 is added. The length of the intermediate area 55, taken between the wheel 49 and the wheel 51, is generally comprised between 10 mm and 20 mm.

Besides, the maximum transverse extension l1 of the intermediate area 55, taken perpendicularly to the C-C' axis, is less than 0.8 times, preferably less than 0.7 times, the maximum transverse extension l2, l3 of at least one of the tools 49, 51, preferably both tools 49, 51, taken perpendicularly to the C-C' axis.

These transverse extensions are here diameters; the tools 49, 51 and the spacer 50 having sections with a circular outline in a plane that is perpendicular to the C-C' axis.

Figure 3:
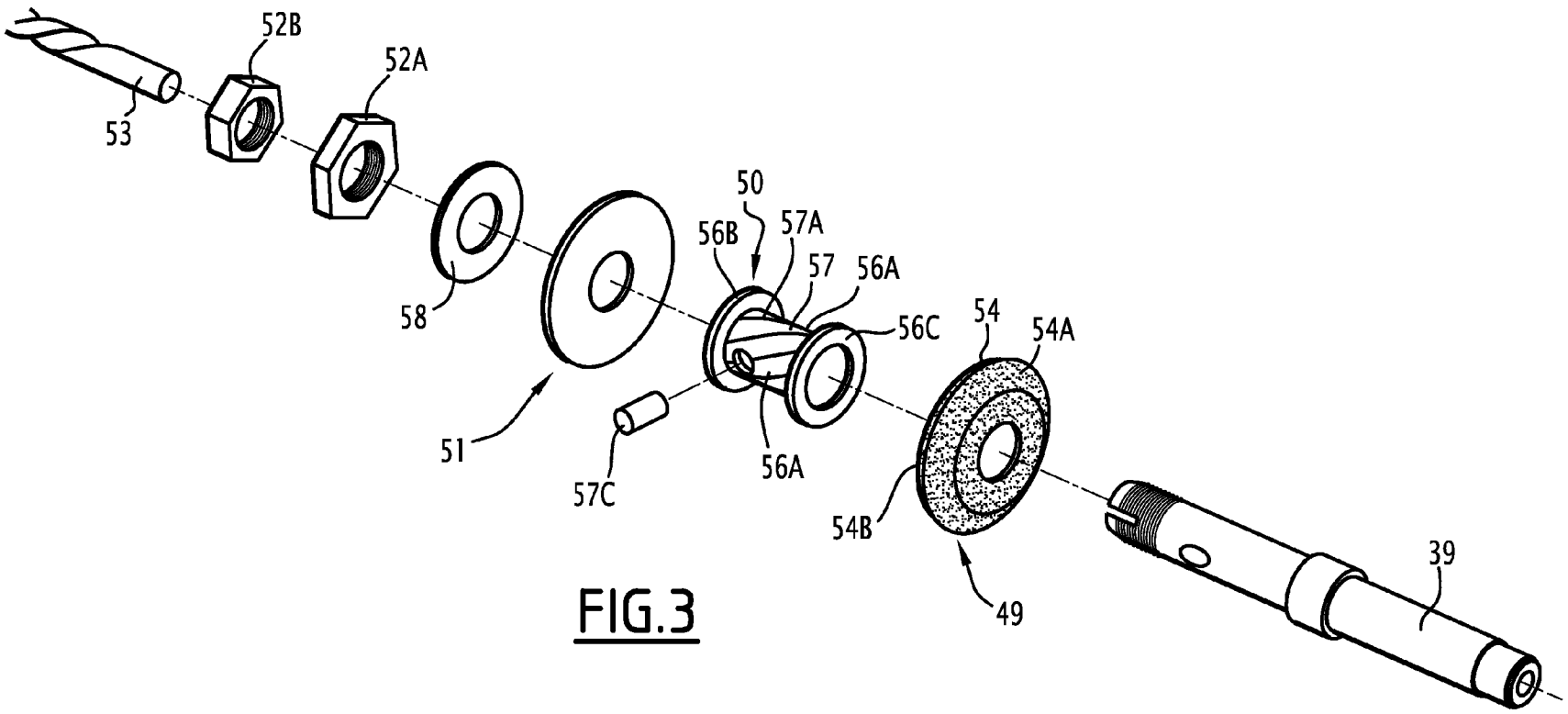
FIG. 3 is an exploded perspective view of the different parts mounted on the tool holder shaft.

The spacer 50 is added around the rotary shaft 39 coaxially with the C-C' axis. As illustrated by FIG. 3, it contains a hollow cylindrical body 56A and two end flanges 56B, 56C protruding radially with respect to the body 56A.

The spacer 50 delimits an internal axial bore into which the rotary shaft 39 is inserted. The bore opens out axially through the flanges 56C, 56B.

According to the invention, the spacer 50 delimits, at least on the body 56A, an external peripheral surface 57 for machining the lens.

The surface 57 has an outer cover that is substantially cylindrical. It is equipped, for example, with gear teeth 57A which may be straight or helical. The gear teeth 57A have at least one outer cutting edge intended to remove material in the lens 15. Thus, the intermediate area 55 forms a cutting tool for machining the lens 15.

Alternatively, the outer surface 57 has a plurality of abrasive protrusions (not shown) intended to polish the outside of the lens 15.

Thus, during the rotation of the tool holder shaft 39 around the C-C' axis, the outer surface 57 is driven into rotation, which allows material to be machined in the lens 15 when the lens 15 is placed in contact with this surface 57.

Advantageously, the machining surface 57 extends over the entire length of the body 56A, as well as over more than 70% of the length of the intermediate area 55, with these lengths taken parallel to the C-C' axis.

The flanges 56B, 56C are applied on the scoring wheel 51 and on the counter-beveling wheel 49 respectively, in order to maintain the axial spacing between these wheels 49, 51.

In this example, the outer peripheral surface of the flanges 56B, 56C is without any gear teeth or abrasive member. This outer peripheral surface is smooth.

Alternatively, gear teeth or abrasive members may be positioned on the outer surface of the flanges 56B, 56C.

The spacer 50 is attached onto the rotary shaft 39 by means of a fastening member 57C, which is visible in FIG. 3, in order to be driven into a joint rotation with the shaft 39 around the C-C' axis. The spacer 50 is thus fixed in rotation with respect to the shaft 39, which prevents it from slipping when the cutting torque becomes too large.

In this example, the holding members 52A, 52B are formed by nuts screwed on the free end of the shaft 39. The member 52A is applied against the wheel 51, advantageously via a washer 58.

The scoring wheel 51 is thus gripped between the flange 56B and the holding member 52A.

The holding member 52B grips the drilling tool 53 radially in order to maintain it in position in a cavity opening out at the end of the shaft 39.

The drilling tool 53 is formed by a drill mounted on the free end of the tool holder shaft 39. The tool 53 is aligned following the C-C' axis and is mobile jointly in rotation with the shaft 39.

With reference to FIG. 1, the arm 37, and then the tool holder 39, is mobile in rotation around the B-B' axis with an angular displacement of at least 30°, and preferably, of 180°, being able to notably assume an upper vertical position, in which the second C-C' axis is substantially parallel to the first A-A' axis, and a plurality of inclined positions, in which the second C-C' axis is inclined with respect to the first A-A' axis.

In the example illustrated by FIG. 1, the tool holder shaft 39 lies substantially in the vertical plane, which passes through the first A-A' axis, regardless of its position around the B-B' axis.

The motor 41 for driving the tool holder shaft 39 into rotation is attached onto the connecting arm 37. It is connected to the shaft 39 by transmission means 59 positioned in the arm 37.

The means 43 for adjusting the inclination angle of the tool holder shaft 39 comprise a motor 61 for actuating a worm screw 63, and a tangential toothed wheel 65 mounted interdependently with the connecting arm 37. The worm screw 63 extends along a direction that is substantially parallel to the first A-A' axis.

The toothed wheel 65 is attached onto the arm 37 at its free end 45. It extends in a plane that is substantially parallel to the plane defined by the first A-A' axis and the second C-C' axis.

The means 23 for relative axial and radial positioning of the tool holder set 21 with respect to the lens support 19 comprise, for example, means 71 for tilting the trolley 27 around its tilting axis X-X', and means 73 for axial translation of the tool holder set 21 along an axis D-D' parallel to the first A-A' axis.

The control unit 25 drives the displacement of the tool holder set 21 along the D-D' axis, on the one hand, and the displacement of the trolley 19 around the X-X' axis on the other hand. The latter movement may be assimilated to a pseudo-translation movement along an axis that is perpendicular to the first A-A' axis.

The control unit 25 moreover controls the means 23 for axial and radial positioning in order to selectively position the wheels 49 and 51, as well as the drilling tool 53, in contact with the periphery 13 of the lens 15.

The control unit 25 is connected to the motor 61 for actuating the inclination means 43 in order to control the rotation of the worm screw 63 in a first direction or in the direction opposite to the first direction, so as to adjust the inclination of the second C-C' axis with respect to the first A-A' axis.

The control unit 25 is connected to a computer 77, which allows calculation of one or each inclination angle of the finishing wheel 49, as described below.

An exemplary machining method according to the invention will now be described. Initially, the thickness of the lens is measured over its outline by the measurement means (not shown).

Then the profiled lens 15, which advantageously has its definitive outline, is wedged between the two ends 33A, 33B of the half-shafts 29A, 29B by means of an adapter suitably positioned on the lens 15. The axis A-A' of rotation of the lens 15 coincides, for example, with its optical axis.

And the operator may then choose to perform a scoring operation, a counter-beveling operation and/or a drilling operation.

In the case of a scoring operation, the scoring wheel 51 is brought to contact with the peripheral surface 13.

The angle formed by the C-C' axis of the shaft 39 and by the axis A-A' for rotation of the lens is selected depending on the characteristics of the groove to be formed in the lens 15. This angle may be modified for each angular position of the lens 15 around the A-A' axis or may be maintained constant to a predetermined calculated value, as described, for example, in French application No. 04 05 427 of the applicant.

In order to control this angle at each angular position of the lens 15, the actuation motor 61 is actuated to drive the worm screw 63 into rotation, and then the support arm 37, until the angle $\alpha$ formed by the first A-A' axis and second C-C' axis corresponds to the required angle.

The groove is then formed in the peripheral surface 13 by driving the lens 15 into rotation around the A-A' axis, while the scoring wheel 51 is driven into rotation around the C-C' axis together with the shaft 39.

When a counter-bevel has to be made, the peripheral edge delimiting the front face 16A is brought into contact with the face 54B of the counter-beveling wheel 49. The angle $\alpha$ between the axes A-A' and C-C' is adjusted to exhibit the selected counter-bevel angular characteristics.

Likewise, a counter-bevel may be made along the peripheral edge of the rear face 16B by bringing this edge into contact with the face 54A of the counter-beveling wheel 49.

When a drilling has to be made, the end of the drilling tool 53 is brought into contact with the front face 16A of the lens 15 at the level of the drilling point. The inclination angle $\alpha$ between the axes A-A' and C-C' is adjusted depending on the desired drilling direction. And then the shaft 39 is driven into rotation and is displaced along its C-C' axis via the displacement means 25 in order to perform the drilling.

According to the invention, the operator may also choose to machine the outer outline of the lens 15 with the help of the machining surface 57 in the intermediate area 55 of the tool holder shaft 39. To this end, he selects a predetermined inclination angle between the axes A-A' and C-C' and adjusts this angle with the help of the adjusting means 43, as has been described above.

Then the tool holder set 21 is displaced with respect to the lens support 19 in order to bring the peripheral surface 13 into contact with the machining surface 57 of the intermediate area 55.

The means for machining the lens 15, which are available on the machining surface 57, are then driven into rotation around the C-C' axis together with the shaft 39.

The lens 15 is machined at a determined angular position around the A-A' axis or at several angular positions while driving into rotation the lens 15 around its A-A' axis.

Therefore, it is possible to adjust the outer outline of the lens 15 by performing precise and oriented machining, which would be difficult to apply on a set of conventional wheels. In particular, the rotation axis C-C' of the machining surface 57 may be inclined by a selected inclination, which is not equal to zero, with respect to the rotation axis of the lens 15.

In addition, it is possible to perform exterior polishing of the peripheral surface 13, once the scoring or the counter-beveling of this surface has been completed. Therefore, it is not necessary to go back to a set of wheels comprising a finishing wheel.

The presence of an intermediate area 55 provided with an outer surface 57 for machining the lens between two machining tools 49, 51 thus increases the functionalities of the grinding machine 11 while preserving reduced dimensions at the same time. Such an arrangement further improves the productivity of the method for grinding an ophthalmic lens.

Figure 4:
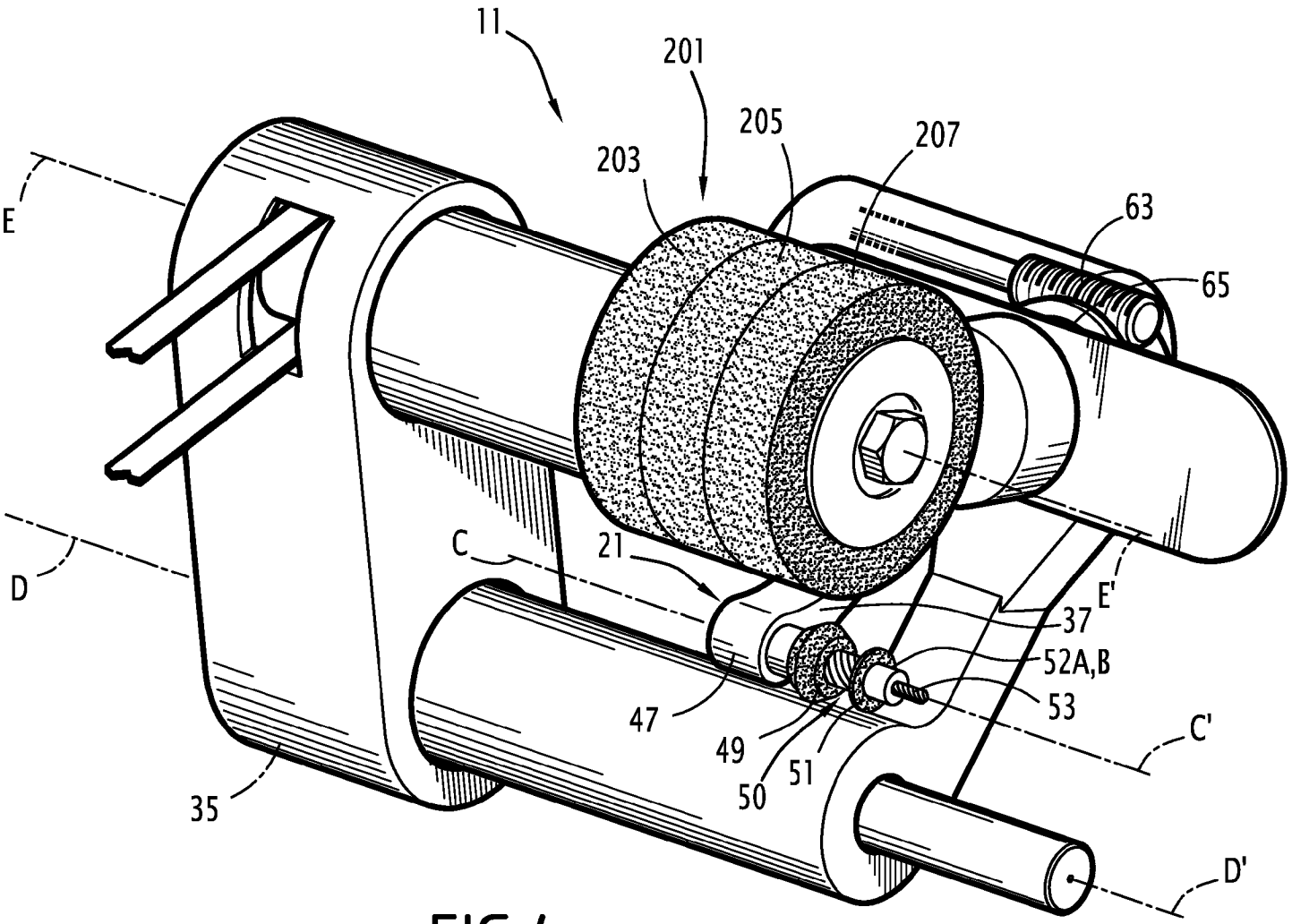
FIG. 4 is a three-quarter perspective front view of the set of wheels according to the invention.

In an alternative illustrated in FIG. 4, the grinding machine 11 further comprises a set of wheels 201 including, for example, a roughening wheel 203, a finishing wheel 205 and a polishing wheel 207. The set of wheels 201 is mounted integral in translation with the support 35, and the tool holder set 21 is retractable under the set of wheels 201 by rotation around the B-B' axis.

The wheels 203, 205 and 207 are rotatably mounted with respect to the support 35 around an axis of the wheels E-E' parallel to the first A-A' axis. The axis E-E' extends in a vertical plane passing substantially through the first A-A' axis.

The method then comprises a step of roughening the lens 13, prior to the step of grinding the bevel 16.

Alternatively, a surface 57 for machining the lens is formed in an intermediate area of the tool holder shaft 39 positioned between the wheel 51, which is closest to the free end of the shaft 39, and the drilling tool 53. As earlier, this intermediate area advantageously has a maximum transverse extension less than 0.8 times the transverse extension of the wheel 51.

The invention claimed is:

1. A grinding machine for grinding optical glasses, the grinding machine comprising:

a base frame;

a lens support mounted on the frame, the lens support comprising means for driving a lens into rotation around a first axis; and a tool holder set including a rotary shaft disposed around a second axis, the rotary shaft bearing at least two tools for machining the lens, spaced out along the second axis, and a spacer positioned in an intermediate area located between both machining tools, the spacer defining an outer surface for machining the lens, the outer surface being equipped with gear teeth having at least one cutting edge configured to remove material in the lens, and means for inclining the first axis with respect to the second axis.

2. The machine according to claim 1, wherein the spacer extends as a single piece between a first axial end applied on one of the two tools and a second axial end applied on the other of the two tools.

3. The machine according to claim 1, wherein the spacer has a substantially cylindrical form.

4. The machine according to claim 1, wherein the outer surface for machining the lens extends substantially over the entire length of the spacer.

5. The machine according to claim 1 claims, wherein a first machining tool is a scoring wheel, a second machining tool is a counter-beveling wheel, and the spacer is positioned between the scoring wheel and the counter-beveling wheel.

6. The machine according to claim 1, wherein the first machining tool is a drilling tool positioned at a free end of the rotary shaft, a second machining tool is a scoring wheel or a counter-beveling wheel, and the spacer is located between the drilling tool and the wheel that is closest to the drilling tool.

7. The machine according to claim 1, wherein the spacer forms a cutting tool for machining the lens.

8. The machine according to claim 1, wherein the intermediate area has a maximum radial extent of less than 0.8 times the maximum radial extent of at least one of the two machining tools delimiting the intermediate area.

9. The machine according to claim 1, wherein the length of the spacer, taken along the second axis, is between 10 mm and 20 mm.

10. The machine according to claim 1, wherein the tool holder set includes a fastening member configured to immobilize the spacer on the rotary shaft in rotation around the second axis with respect to the rotary shaft.

11. The machine according to claim 1, further comprising a set of machining wheels rotatably mounted on the frame around a machining wheels axis of the wheels, the machining wheels axis being substantially parallel to the first axis.

* * * * *